US011440322B2

(12) United States Patent
Mou et al.

(10) Patent No.: US 11,440,322 B2
(45) Date of Patent: Sep. 13, 2022

(54) NARROW TYPE INKJET PRINT HEAD CHIP

(71) Applicant: Microjet Technology Co., Ltd., Hsinchu (TW)

(72) Inventors: Hao-Jan Mou, Hsinchu (TW); Rong-Ho Yu, Hsinchu (TW); Cheng-Ming Chang, Hsinchu (TW); Hsien-Chung Tai, Hsinchu (TW); Wen-Hsiung Liao, Hsinchu (TW); Chi-Feng Huang, Hsinchu (TW); Yung-Lung Han, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 0 days.

(21) Appl. No.: 17/206,816

(22) Filed: Mar. 19, 2021

(65) Prior Publication Data

US 2021/0291523 A1 Sep. 23, 2021

(30) Foreign Application Priority Data

Mar. 20, 2020 (TW) ..... 109109504

(51) Int. Cl.
*B41J 2/14* (2006.01)

(52) U.S. Cl.
CPC ..... *B41J 2/14314* (2013.01)

(58) Field of Classification Search
CPC ..... B41J 2/14104; B41J 2/14314; B41J 2/14072; B41J 2/04511; B41J 2/0458; B41J 2/1601; B41J 2/1635; B41J 2/1608; B41J 2/162; B41J 2202/13; B41J 2/1632; B41J 2/1631
See application file for complete search history.

(56) References Cited

U.S. PATENT DOCUMENTS

2002/0003557 A1* 1/2002 Miyakoshi ..... B41J 2/14072 347/50
2012/0050408 A1* 3/2012 Fang ..... B41J 2/145 347/40
2019/0240980 A1* 8/2019 Schina ..... B41J 2/1603
2020/0338888 A1* 10/2020 Sakuma ..... B41J 2/14129

FOREIGN PATENT DOCUMENTS

TW 200416144 A 9/2004
TW 201238777 A 10/2012

* cited by examiner

*Primary Examiner* — Kristal Feggins
(74) *Attorney, Agent, or Firm* — Birch, Stewart, Kolasch & Birch, LLP

(57) ABSTRACT

A narrow type inkjet print head chip is disclosed and includes a silicon substrate, an active component layer and a passive component layer. The active component layer is stacked on the silicon substrate and includes plural ESD protection units, plural encoder switches, plural discharge protection units and plural heater switches. The ESD protection units, the encoder switches, the discharge protection units and the heater switches are disposed in each of at least two high-precision regions of the active component layer. The corresponding positions and quantities of these components are the same in the at least two high-precision regions. The passive component layer is stacked on the active component layer and includes plural heaters, plural electrode pads, plural encoders and plural circuit traces. The circuit traces are electrically connected to the ESD protection units, the encoder switches, the heater switches, the heaters, the electrode pads and the encoders.

9 Claims, 11 Drawing Sheets

NARROW TYPE INKJET PRINT HEAD CHIP

FIELD OF THE INVENTION

The present disclosure relates to an inkjet print head chip, and more particularly to a modular inkjet print head chip including a metal oxide semiconductor.

BACKGROUND OF THE INVENTION

With the rapid development of technology, the size and shape of an inkjet print head are also changing according to the requirements of different customers, for example faster printing speeds. However, the changes in the size and shape of the inkjet head are limited by the size of the photomask in the manufacturing process, and increase the production costs.

Please refer to FIG. 1. A conventional inkjet print head chip 9 includes a plurality of electrode pads 91, a plurality of electro static discharge (ESD) protection units 92, a plurality of heaters 93, a plurality of heater switches 94, a plurality of encoders 95, a plurality of encoder switches 96, and a plurality of discharge protection units 97. The plurality of electrode pads 91 are adjacently arranged on two opposed sides of the inkjet print head chip 9. The plurality of ESD protection units 92 are arranged next to the plurality of electrode pads 91, respectively. The plurality of heaters 93 are adjacently and symmetrically arranged on the other two opposed sides of the inkjet print head chip 9. The plurality of heater switches 94 are arranged adjacent to the plurality of heater 93, respectively. The plurality of encoders 95 are arranged adjacent to one part of the inkjet head print chip 9. The plurality of encoder switches 96 are arranged adjacent to the plurality of encoder 95, respectively. The plurality of discharge protection units 97 are adjacently arranged on another part of the inkjet print head chip 9.

Please refer to FIG. 1 and FIG. 2. In order to drive the heater 93, for example, the heater switch 94 is turned on by applying a proper voltage to the electrode pad 91, and at the same time, the corresponding heater 93 is further driven by applying a proper voltage to the electrode pad 91.

However, in the conventional inkjet print head chip 9, since the ESD protection unit 92 needs to be arranged adjacent to the corresponding electrode pad 91, and the heater switch 94 needs to be arranged adjacent to the corresponding heater 93, the flexibility in configuration is low. Furthermore, due to the size limitation of photomask, it is difficult to produce a narrow type inkjet print head in response to customization requirements for industrial use.

SUMMARY OF THE INVENTION

An object of the present disclosure is to provide a narrow type inkjet print head chip including complementary metal oxide semiconductor (CMOS) or N-type metal oxide semiconductor (NMOS) circuits, which is not limited by the size of the photomask, and is able to form various lengths and shapes of print heads by changing a part of the photomask. It has advantages of high flexibility and low production cost.

In accordance with an aspect of the present disclosure, a narrow type inkjet print head chip is provided and includes a silicon substrate, an active component layer and a passive component layer. The silicon substrate includes a first long side, a second long side opposite to the first long side, a first short side connected to the first long side and the second long side, and a second short side connected to the first long side and the second long side, and opposite to the first short side. The active component layer is stacked on the silicon substrate and includes a plurality of electro static discharge (ESD) protection units disposed adjacent to the first long side and arranged along the first long side, a plurality of encoder switches disposed adjacent to the first long side and arranged along the first long side, a plurality of discharge protection units disposed adjacent to the first long side and arranged along the first long side, and a plurality of heater switches disposed in parallel with the plurality of electro static discharge (ESD) protection units. The plurality of electro static discharge (ESD) protection units, the plurality of encoder switches, the plurality of discharge protection units and the plurality of heater switches are disposed in each of at least two high-precision regions of the active component layer, respectively, wherein the corresponding positions and quantities of the plurality of electro static discharge (ESD) protection units, the plurality of encoder switches, the plurality of discharge protection units and the plurality of heater switches are the same in the at least two high-precision regions. The passive component layer is stacked on the active component layer and includes a plurality of heaters arranged along the second long side, a plurality of electrode pads, a plurality of encoders arranged along the first long side and adjacently connected to the plurality of encoder switches, respectively, and a plurality of circuit traces electrically connected to the plurality of electro static discharge (ESD) protection units, the plurality of encoder switches, the plurality of discharge protection units, the plurality of heater switches, the plurality of heaters, the plurality of electrode pads and the plurality of encoders.

BRIEF DESCRIPTION OF THE DRAWING

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or limited to the precise embodiments disclosed.

Figure 1:
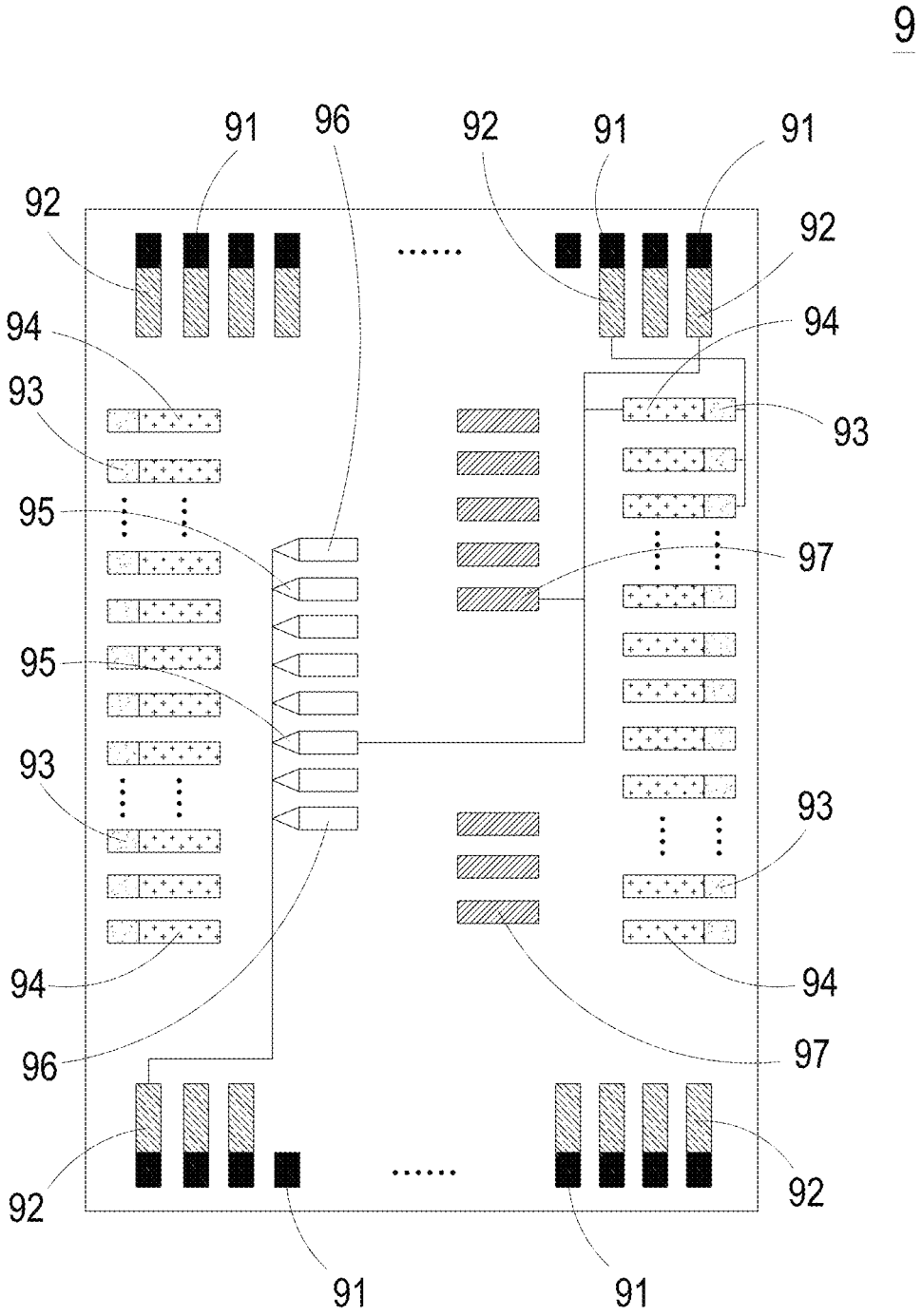
FIG. 1 is a schematic diagram illustrating the layout of a conventional inkjet print head chip according to the prior art.
Figure 2:
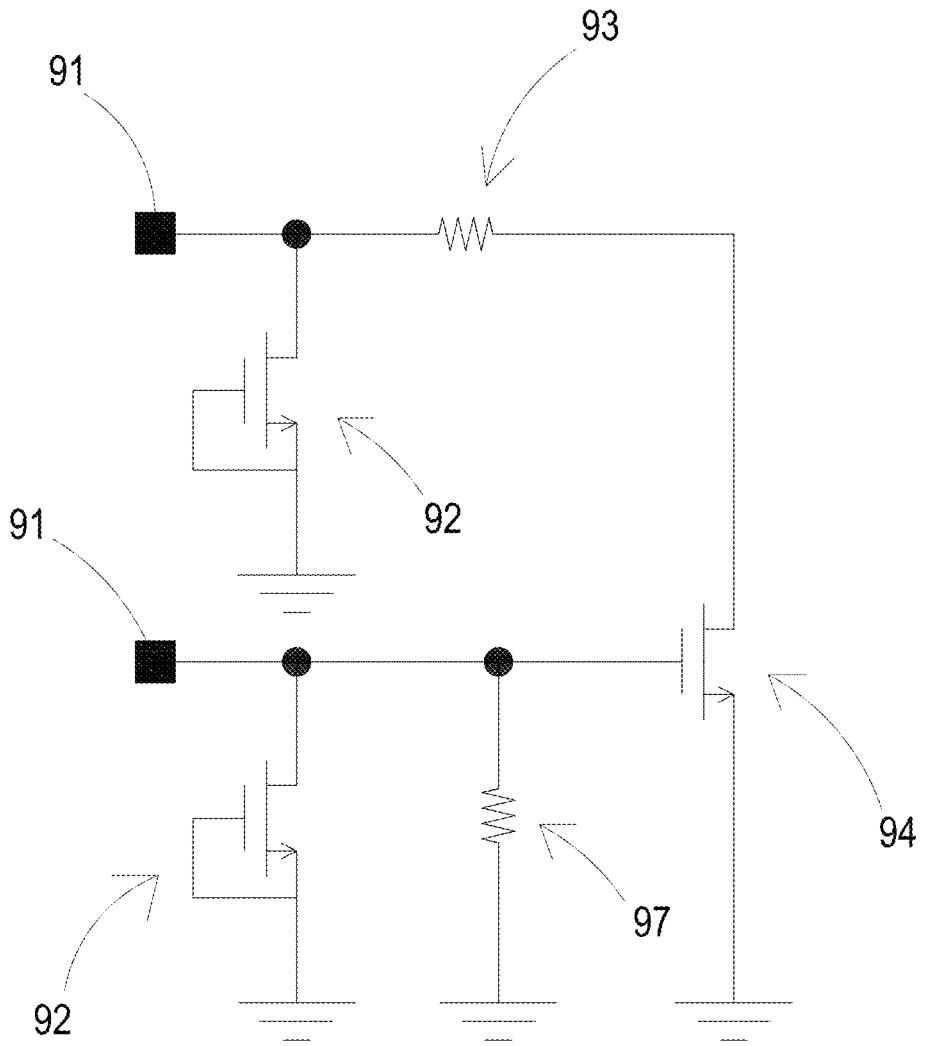
FIG. 2 is a partial circuit diagram illustrating the conventional inkjet print head chip according to the prior art.
Figure 3A:
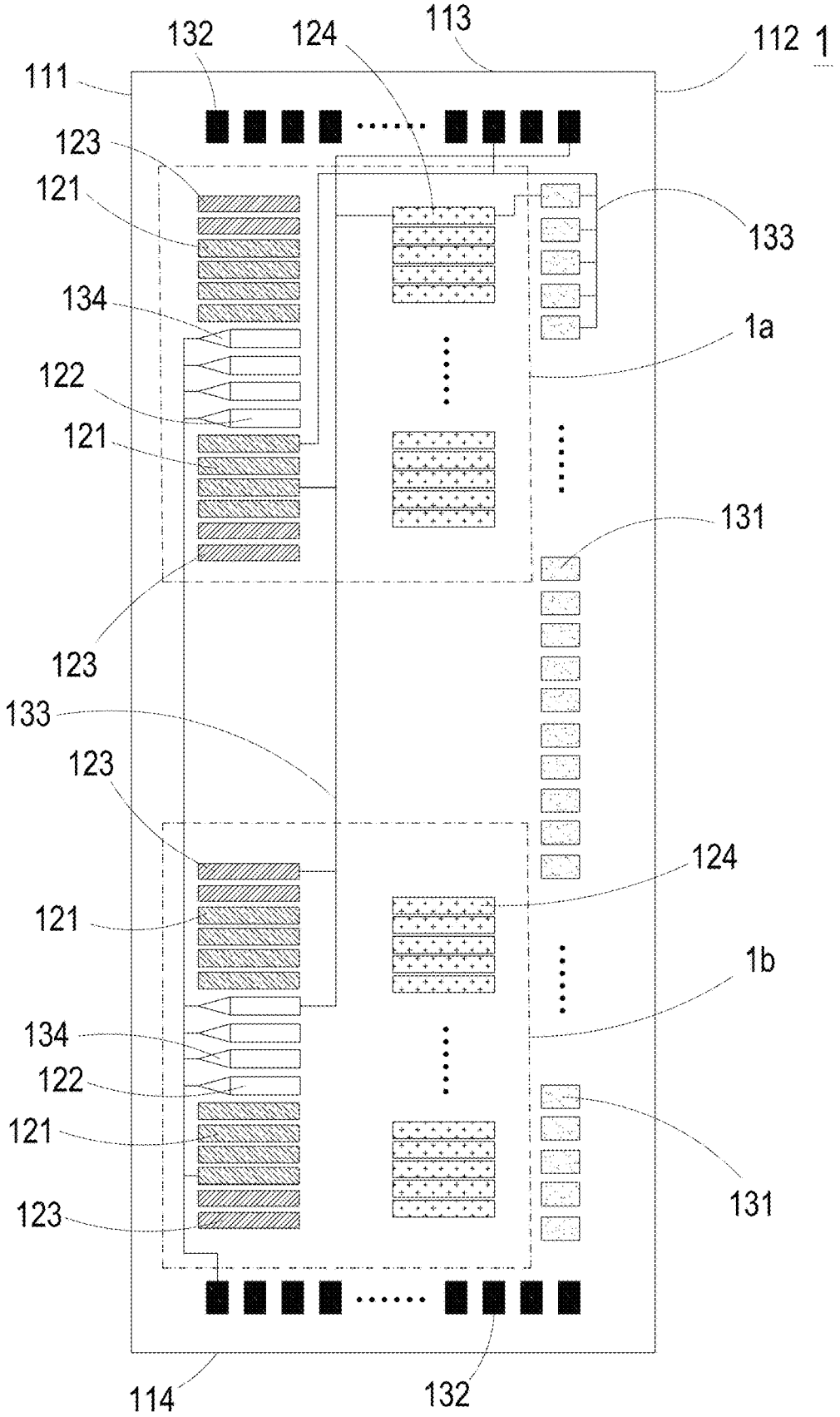
FIG. 3A is a schematic diagram illustrating a narrow type inkjet print head chip according to a first embodiment of the present disclosure.
Figure 3B:
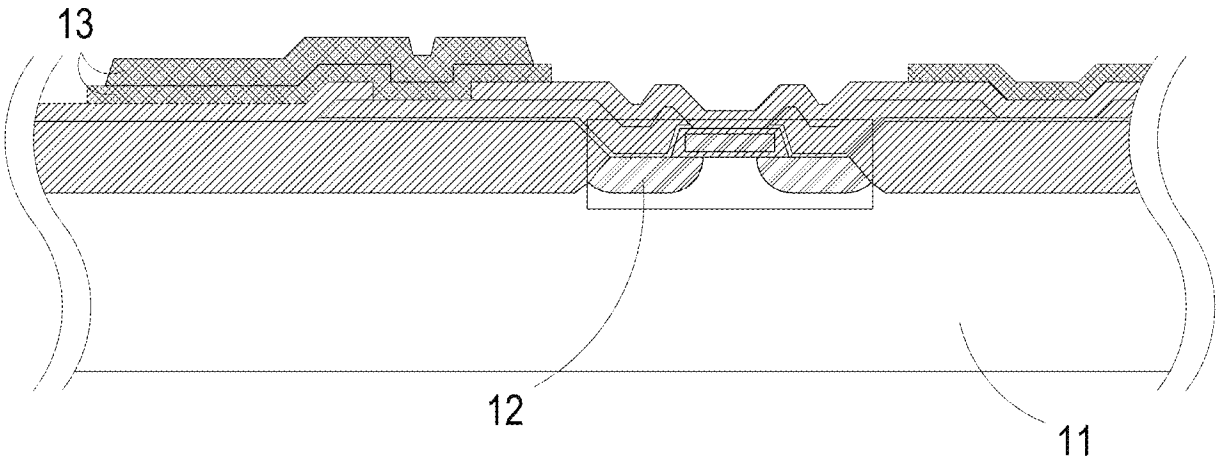
FIG. 3B is a schematic cross-sectional view illustrating the narrow type inkjet print head chip according to the present disclosure.

Please refer to FIG. 3A and FIG. 3B. In the embodiment, a narrow type inkjet print head chip 1 includes a silicon substrate 11, an active component layer 12 and a passive component layer 13. The silicon substrate 11 includes a first long side 111, a second long side 112, a first short side 113 and a second short side 114. The first long side 111 and the second long side 112 are opposite to each other. The first short side 113 and the second short side 114 are opposite to each other and connected to the first long side 111 and the second long side 112, respectively.

The active component layer 12 is stacked on the silicon substrate 11. The active component layer 12 includes a plurality of electro static discharge (ESD) protection units 121, a plurality of encoder switches 122, a plurality of discharge protection units 123 and a plurality of heater switches 124. The EDS protection units 121 are disposed adjacent to the first long side 111 and arranged along the first long side 111. The plurality of encoder switches 122 are disposed adjacent to the first long side 111 and arranged along the first long side 111. The plurality of discharge protection units 123 are disposed adjacent to the first long side 111 and arranged along the first long side 111. In the embodiment, the ESD protection units 121, the encoder switches 122 and the discharge protection units 123 are arranged in a row along the first long side 111, but the present disclosure is not limited thereto. The heater switches 124 are located at the middle area of the narrow type inkjet print head chip 1, and disposed in parallel with the ESD protection units 121, the encoder switches 122 and the discharge protection units 123.

In the embodiment, the narrow type inkjet print head chip 1 includes at least two high-precision regions, and the plurality of ESD protection units 121, the plurality of encoder switches 122, the plurality of discharge protection units 123 and the plurality of heater switches 124 are disposed in each of the at least two high-precision regions of the active component layer 12, respectively. Preferably but not exclusively, corresponding positions and quantities of the plurality of ESD protection units 121, the plurality of encoder switches 122, the plurality of discharge protection units 123 and the plurality of heater switches 124 are the same in the at least two high-precision regions.

The passive component layer 13 is stacked on the active component layer 12. The passive component layer 13 includes a plurality of heaters 131, a plurality of electrode pads 132, a plurality of circuit traces 133 and a plurality of encoders 134. The plurality of heaters 131 are arranged along the second long side 112 of the silicon substrate 11, and arranged in a row. The plurality of electrode pads 132 are arranged along the first short side 113 and the second short side 114. In the embodiment, a part of the electrode pads 132 are arranged along the first short side 113, and another part of the electrode pads 132 are arranged along the second short side 114, and the present disclosure is not limited thereto. The plurality of encoders 134 are arranged along the first long side 111, and adjacently connected to the corresponding encoder switches 122, respectively. The plurality of circuit traces 133 are electrically connected to the plurality of ESD protection units 121, the plurality of encoder switches 122, the plurality of discharge protection units 123, the plurality of heater switches 124, the plurality of heaters 131, the plurality of electrode pads 132 and the plurality of encoders 134. Preferably but not exclusively, the circuit traces 133 are respectively disposed on different metal layers, so that the complicated circuit jumper can be reduced. The passive component layer 13 is made of at least one material selected from the group consisting of gold, aluminum, tantalum and a combination thereof.

In the embodiment, the heaters 131 are arranged in a row with 300 dots per inch (DPI), but the present disclosure is not limited thereto. In other embodiment, the arrangement of the heaters 131 is adjustable according to the design requirements.

Notably, in the embodiment, preferably but not exclusively, the discharge protection units 123 are pull down resistor (RPD) protection devices, but not limited thereto. In the embodiment, preferably but not exclusively, the EDS protection units 121, the encoder switches 122, the discharge protection units 123, and the heater switches 124 are N-type metal oxide semiconductor (NMOS) elements, respectively, but not limited thereto. In other embodiments, the ESD protection units 121, the encoder switches 122, the discharge protection units 123 and the heater switches 124 are complementary metal oxide semiconductor (CMOS) elements or bipolar elements, respectively.

Figure 3C:
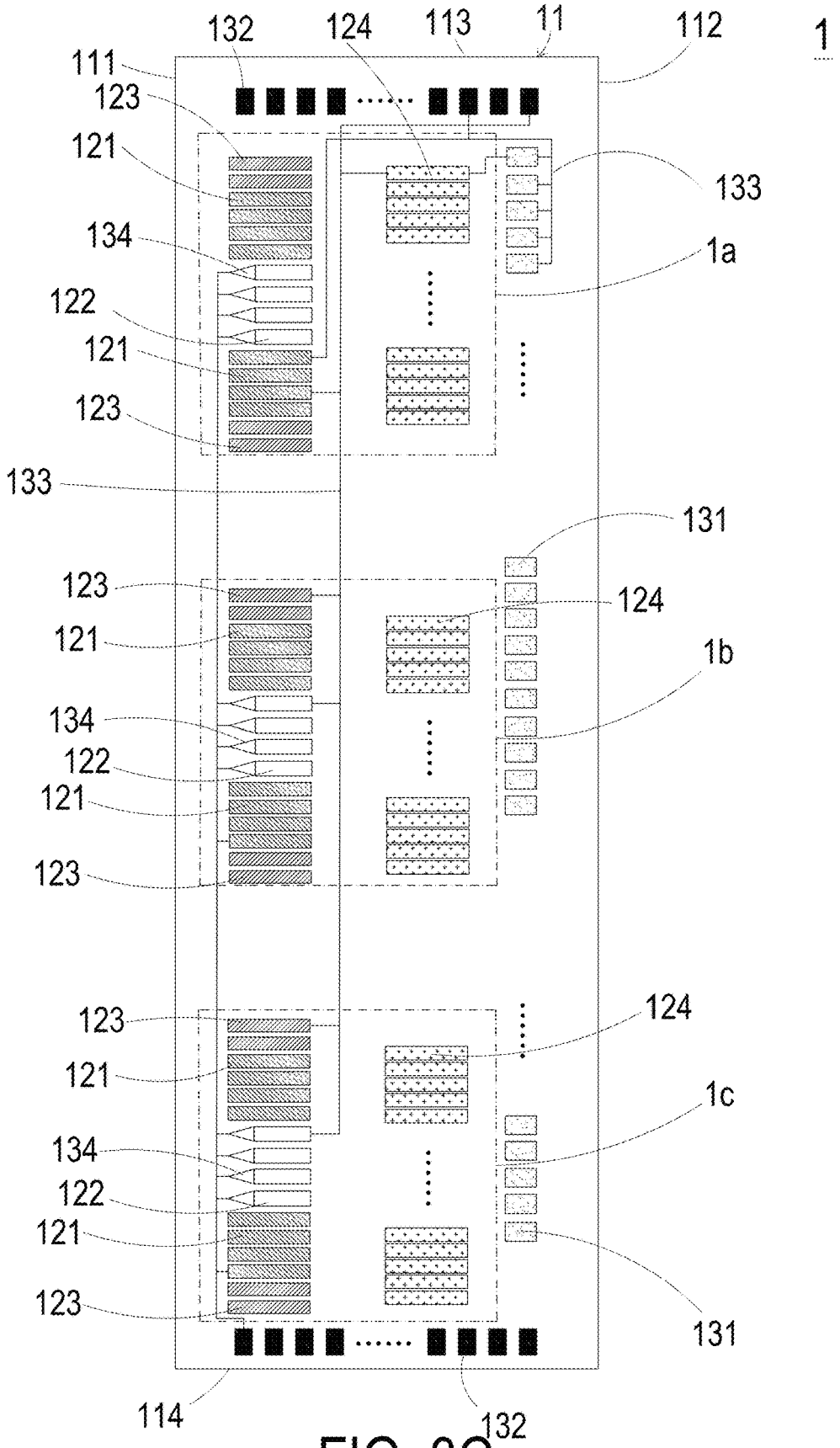
FIG. 3C is a schematic diagram illustrating a narrow type inkjet print head chip according to a second embodiment of the present disclosure.

Please refer to FIG. 3A, again. In the embodiment, the at least two high-precision regions include a first high-precision region 1*a* and a second high-precision region 1*b*. Both of the first high-precision region 1*a* and the second high-precision region 1*b* are in a long and narrow shape, and arranged along the first long side 111. Preferably but not exclusively, the corresponding positions and quantities of the plurality of ESD protection units 121, the plurality of encoder switches 122, the plurality of discharge protection units 123 and the plurality of heater switches 124 are the same in the first high-precision region 1*a* and the second high-precision region 1*b*. Please refer to FIG. 3C, which illustrates a narrow-type inkjet print head chip 1 according to another embodiment of the present disclosure. In the embodiment, the at least two high-precision regions include a first high-precision region 1*a*, a second high-precision region 1*b* and a third high-precision region 1*c*. Preferably but not exclusively, the first high-precision region 1*a*, the second high-precision region 1*b* and the third high-precision region 1*c* are all in a long and narrow shape, and arranged along the first long side 111. In the embodiment, the corresponding positions and quantities of the plurality of ESD protection units 121, the plurality of encoder switches 122, the plurality of discharge protection units 123 and the plurality of heater switches 124 are the same in the first high-precision region 1*a*, the second high-precision region 1*b* and the third high-precision region 1*c*.

In addition, taking the first high-precision region 1*a* as an example, a part of the discharge protection units 123, a part of the ESD protection units 121, the encoder switches 122, another part of the ESD protection units 121 and another part of the discharge protection units 123 are sequencently arranged in a row along the first long side 111, and the heater switches 124 are arranged in parallel with the foregoing components in a row, but not limited thereto. In the embodiment, the corresponding positions and quantities of the components disposed in each high-precision region are the same. Therefore, when the components in the first high-precision region 1*a* are arranged in the above-mentioned manner, the components of the active component layer 12 in the second high-precision region 1*b* (or the third high-precision region 1*c*) are also arranged in the same manner, so that a part of the discharge protection units 123, a part of the ESD protection units 121, the encoder switches 122, another part of the ESD protection units 121 and another part of the discharge protection units 123 are sequentially arranged in a row along the first long side 111, and the heater switches 124 are arranged in parallel with the foregoing components in a row.

Notably, in the embodiment, each high-precision region has a length of 13500 micrometers (μm) and a width of 2500 micrometers (μm). Taking the first high-precision region 1*a* and the second high-precision region 1*b* as an example, the lengthwise distance between the first high-precision region 1*a* and the second high-precision region 1*b* is 100 micrometers (μm). In addition, since the heaters 131 are arranged in a row on the silicon substrate 11 with 300 DPI. In the embodiment, the length and the width of each heater 131 are both 35 micrometers (μm) and the distance between each pair of the heaters 131 is 50 microns (μm). Preferably but not exclusively, a part of the heaters 131 are arranged at the junction of the first high-precision region 1*a* and the second high-precision region 1*b*.

Figure 4:
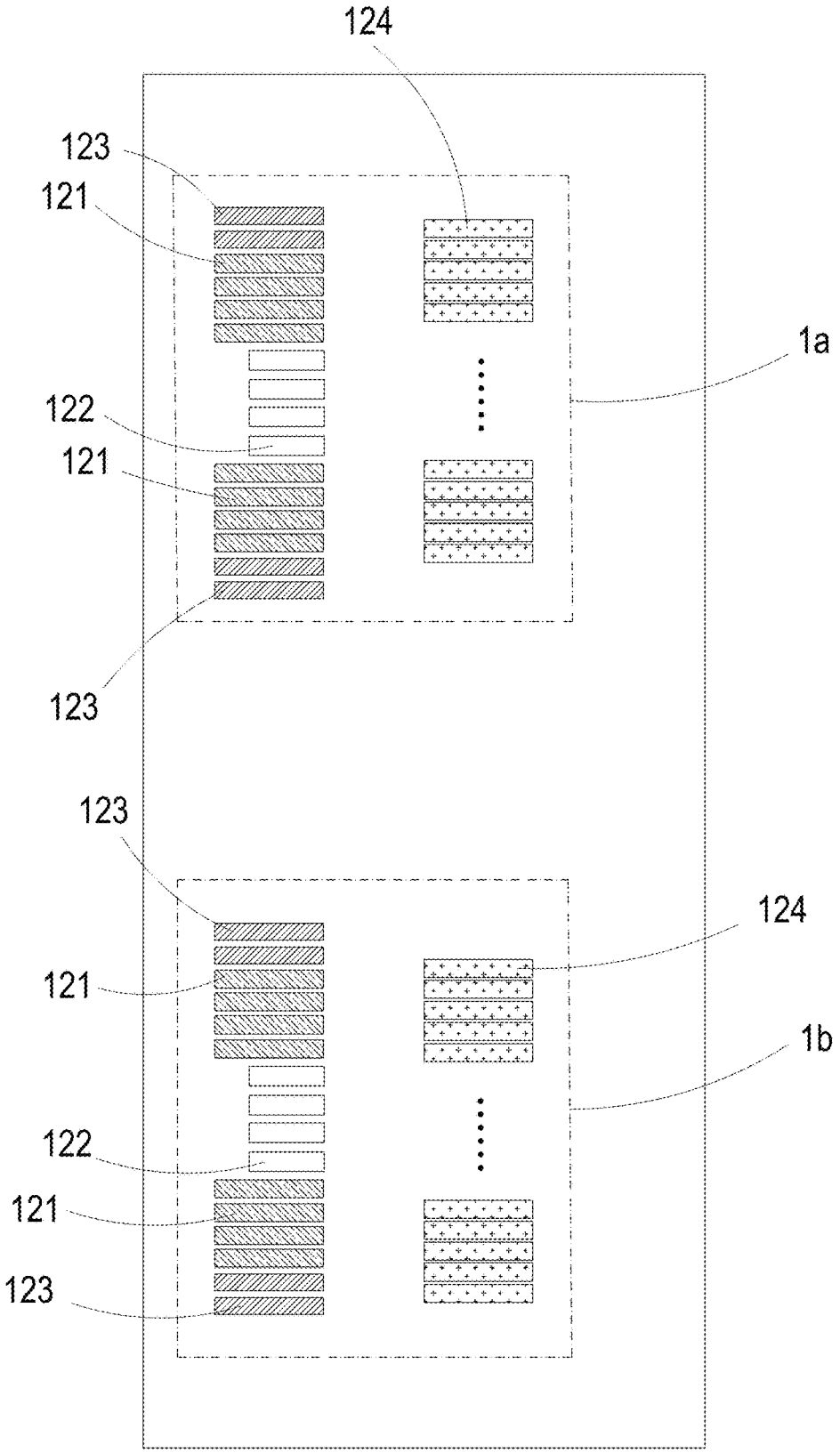
FIG. 4 is a schematic diagram illustrating the layout of the narrow type inkjet print head chip in a front-end manufacturing process according to the present disclosure.

In the embodiment, the manufacturing process of the narrow type inkjet print head chip 1 is divided into a front-end manufacturing process and a back-end manufacturing process. The front-end manufacturing process is shown in FIG. 4. A high-precision photomask is used in the front-end manufacturing process to produce electronic components with higher precision requirements. In the embodiment, the high-precision electronic components are the components of the active component layer 12. Therefore, in the front-end manufacturing process, the electronic components such as the ESD protection units 121, the encoder switches 122, the discharge protection units 123 and the heater switches 124 are disposed on the silicon substrate 11 firstly. In the embodiment, the photomask used in the front-end manufacturing process is a ⅕-fold stepped photomask, but the present disclosure is not limited thereto. In other embodiments, the selection of the photomask used in the front-end manufacturing process is adjustable according to the design requirements. Notably, in the front-end manufacturing process, the ⅕-fold stepping mask is used to fabricate the electronic components in the high-precision regions on the silicon substrate 11 of the narrow type inkjet print head chip 1, and the active component layer 12 is mainly made of multiple layers of materials. Preferably but not exclusively, the multiple layers of the active component layer 12 are formed by stacking sequentially and multiple photomasks are required in the front-end manufacturing process. Take photomasks a1, a2, a3, a4, a5 as an example, the photomasks a1 to a5 are used to expose each layer respectively and sequentially stack the multiple layers. Notably, the narrow type inkjet print head chip 1 includes at least two high-precision regions, such as the first high-precision region 1*a* and the second high-precision region 1*b*. Since the corresponding positions and quantities of the components disposed in the first high-precision region 1*a* and the second high-precision region 1*b* are the same, when the first high-precision region 1*a* and the second high-precision region 1*b* are produced in the exposure process, the same set of photomasks (such as masks a1 to a5) can be used for exposure, and stack the components of the active component layer 12 in the first high-precision region 1*a* and the second high-precision region 1*b*. In the embodiment, the arrangements of the components in the high-precision regions (such as the first high-precision region 1*a* and the second high-precision region 1*b*) are the same, and it facilitates to reduce the time and cost of the process effectively. On the contrary, if the corresponding positions and quantities of the components disposed in the first high-precision region 1*a* and the second high-precision region 1*b* are different and the photomasks used in the first high-precision region 1*a* are for example but not limited to photomasks a1 to a5, the photomasks used in the second high-precision region 1*b* can be for example but not limited to photomasks b1 to b5. It is necessary to use the photomasks a1 to a5 to produce the first high-precision region 1a, and then use the photomasks b1 to b5 to produce the second high-precision region 1*b*. Therefore, the amount of required photomasks is doubled, and the time of the exposure process is also increased.

Figure 5:
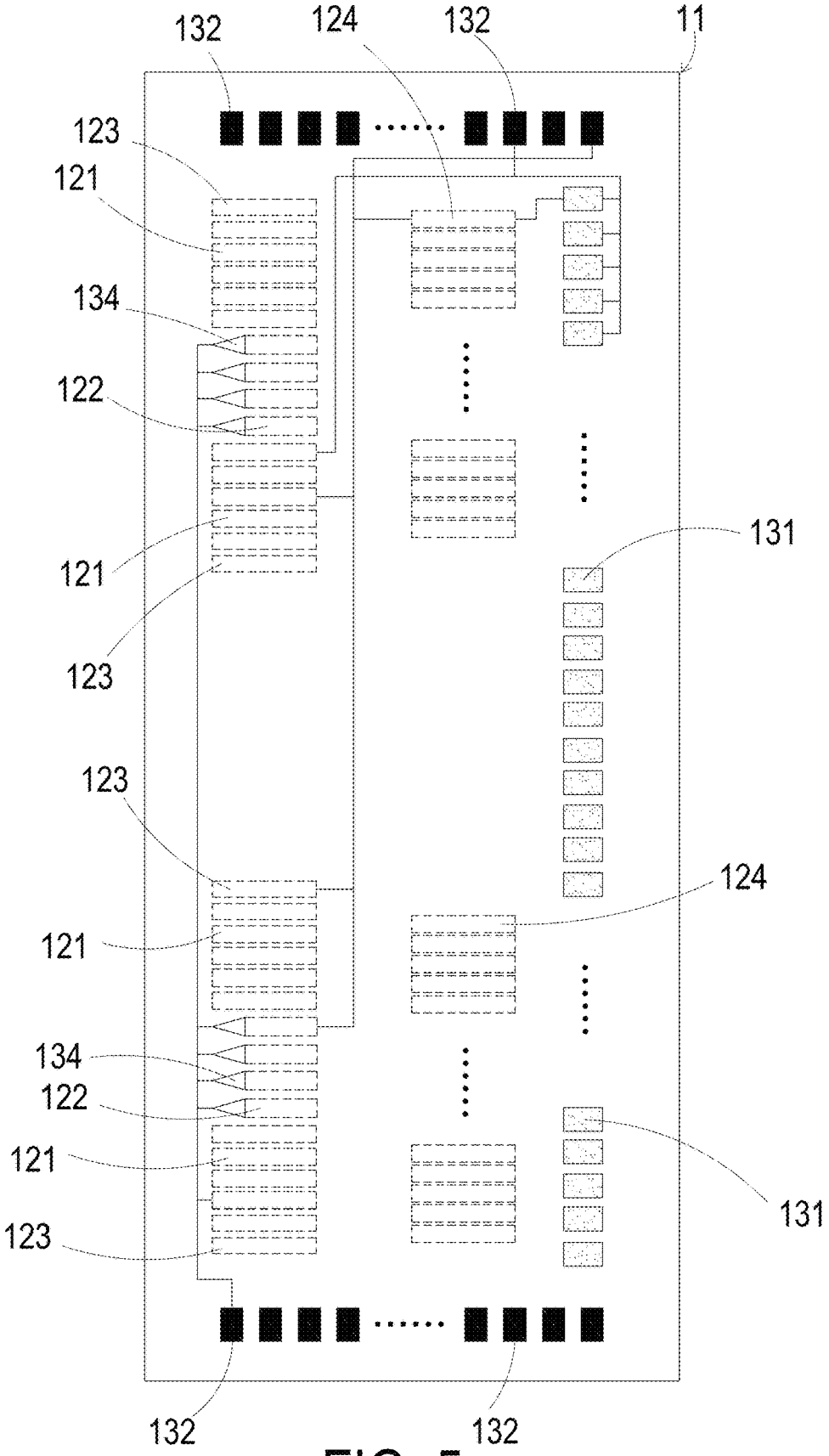
FIG. 5 is a schematic diagram illustrating the layout of the narrow type inkjet print head chip in a back-end manufacturing process according to the present disclosure.

After the components of the active component layer 12 are arranged, the back-end manufacturing process is executed, as shown in FIG. 5. In order to describe the back-end manufacturing process more specifically, the components of the active component layer 12 formed in the front-end manufacturing process are represented in dashed lines. For producing the narrow type inkjet print head chip 1 of the present disclosure, a low-precision photomask is used in the back-end manufacturing process to produce electronic components with lower precision requirements. In the embodiment, the low-precision electronic components are the components of the heaters 131, the electrode pads 132, the circuit traces 133 and the encoders 134 of the passive component layer 13. Therefore, in the embodiment, the photomask used in the back-end manufacturing process is a 1-fold alignment photomask. In that, all the components of the passive component layers 13 on the silicon substrate 11 can be formed at one time.

Figure 6A:
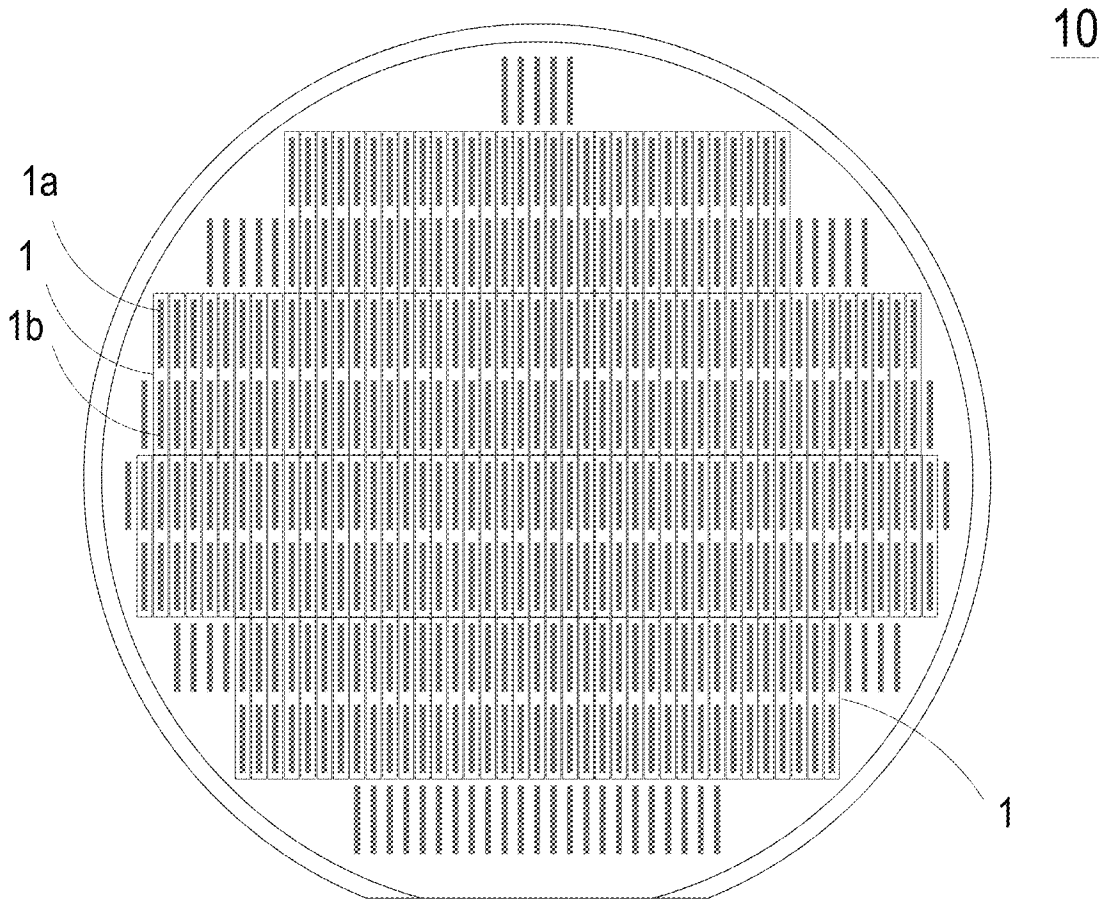
FIG. 6A is a schematic diagram illustrating the narrow type inkjet print head chips arranged on a wafer structure according to an embodiment of the present disclosure.

Please refer to FIG. 6A, which shows the arrangement of 1-inch narrow type inkjet print head chips 1 arranged on a 6-inch semiconductor wafer 10. Each narrow type inkjet print head chip 1 includes two high-precision regions (the first high-precision region 1*a* and the second high-precision region 1*b*). Preferably but not exclusively, each narrow type inkjet print head chip 1 has a length of 27000 micrometers (μm) and a width of 2500 micrometers (μm). Compared with the conventional single inkjet print head chip (having a length of 15000 micrometers (μm) and a width of 4500 microns (μm)), the width of the narrow type inkjet print head chip 1 of the present disclosure is almost halved, so that the total number of dice contained in each 6-inch semiconductor wafer 10 reaches 160 (the total number of dice of the conventional inkjet print head chips is 190). Therefore, the manufacturing cost of the 1-inch narrow type inkjet print head chips 1 on the similar 6-inch semiconductor wafer 10 is controlled within an acceptable range.

Figure 6B:
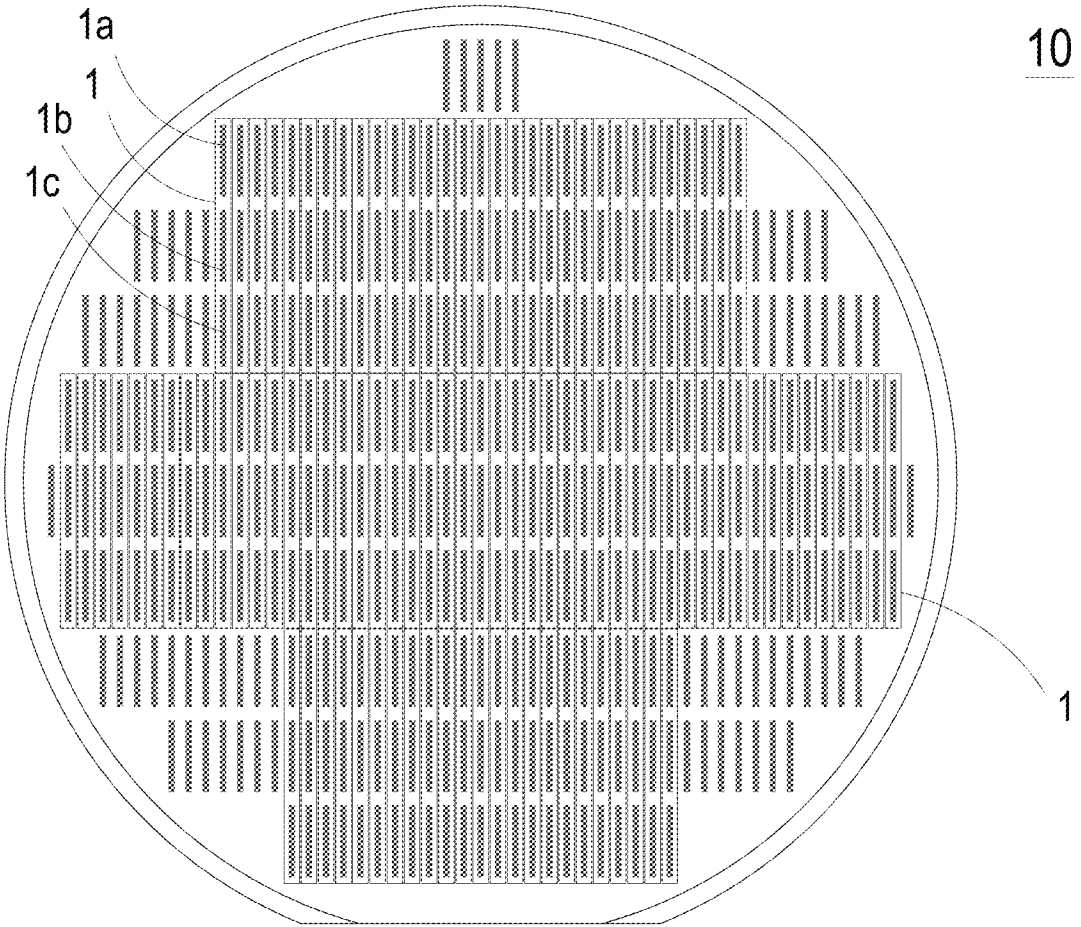
FIG. 6B is a schematic diagram illustrating the narrow type inkjet print head chips arranged on a wafer structure according to another embodiment of the present disclosure.

Please refer to FIG. 6B, which shows the arrangement of 1.5-inch narrow type inkjet print head chips 1 arranged on a 6-inch semiconductor wafer 10. Each narrow type inkjet print head chip 1 includes three high-precision regions (the first high-precision region 1*a*, the second high-precision region 1*b* and the third high-precision region 1*c*). Preferably but not exclusively, each narrow type inkjet print head chip 1 has a length of 40500 micrometers (μm) and a width of 2500 micrometers (μm). In that, the total number of dice contained in each 6-inch semiconductor wafer 10 reaches 100, and the manufacturing cost of the 1.5-inch narrow type inkjet print head chips 1 on the similar 6-inch semiconductor wafer 10 is controlled within an acceptable range.

Figure 7A:
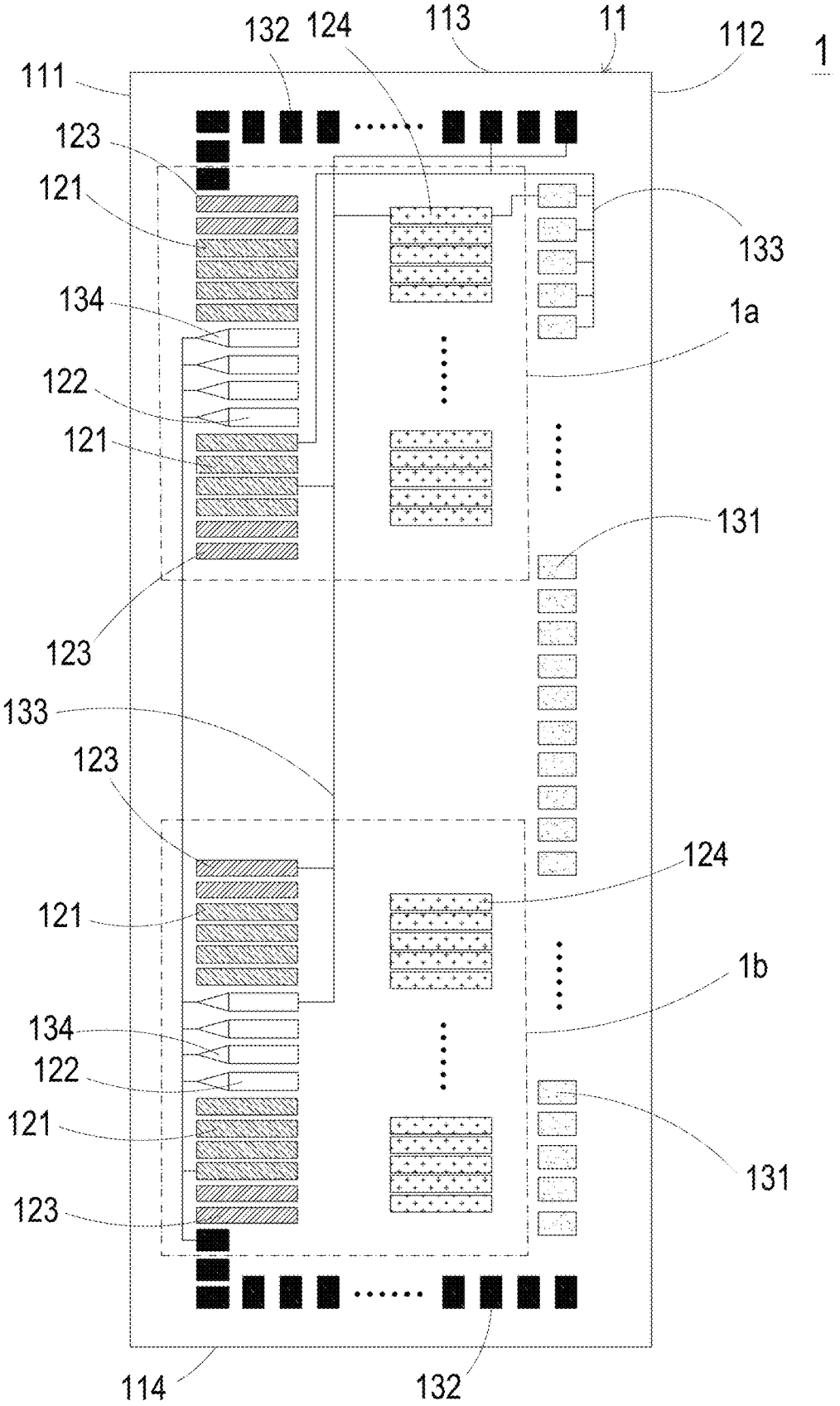
FIG. 7A is a schematic diagram illustrating a plurality of electrode pads of a narrow type inkjet print head chip according to a third embodiment of the present disclosure.
Figure 7B:
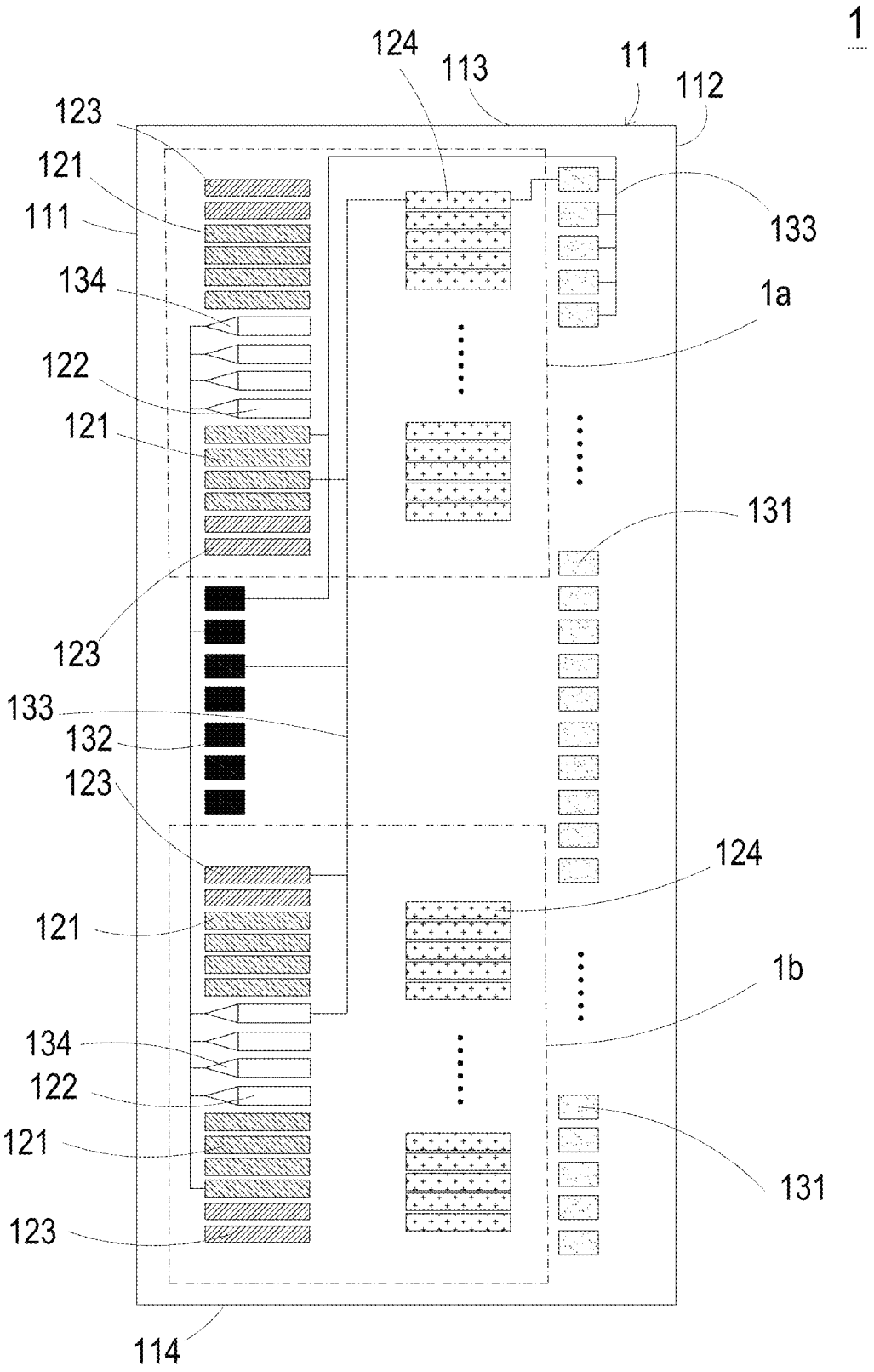
FIG. 7B is a schematic diagram illustrating a plurality of electrode pads of a narrow type inkjet print head chip according to a fourth embodiment of the present disclosure.

Please refer to FIG. 7A, which illustrates a narrow type inkjet print head chip 1 according to a third embodiment of the present disclosure. In the embodiment, a part of the electrode pads 132 are disposed along the first short side 113 and the first long side 111, and arranged in an L-shape. Moreover, another part of the electrode pads 132 are disposed along the second short side 114 and the first long side 111, and arranged in an L-shape. Please refer to FIG. 7B, which illustrates a narrow type inkjet print head chip 1 according to a fourth embodiment of the present disclosure. In the embodiment, the plurality of electrode pads 132 are disposed along the first long side 111, and arranged between the first high-precision region 1*a* and the second high-precision region 1*b*. In the embodiment, after the components of the active device layer 12 are fixed in the first high-precision region 1*a* and the second high-precision region 1*b*, the position and arrangement of the electrode pads 132 can be adjusted and the line width and spacing or wiring configuration can also be adjusted. Thus, the inkjet print head area can be utilized effectively, and thus the area of the inkjet print head can be reduced.

From the above descriptions, the present disclosure provides a narrow type inkjet print head chip. The inkjet print head chip is modularized by modifying the chip layout and the manufacturing process, so as to accelerate the printing speed and meet customer requirements. In addition, the inkjet print head chip includes the circuits of the complementary metal oxide semiconductor (CMOS) or the N-type metal oxide semiconductor (NMOS), which is not limited by the size of the photomask, and has high flexibility and low production cost. On the other hand, the manufacturing process of the present disclosure is divided into a front-end manufacturing process and a back-end manufacturing process. In the front-end manufacturing process, the high-precision electronic components of the active component layer are produced by using the stepped photomasks to perform the exposure processes sequentially. In the back-end manufacturing process, the low-precision electronic components of the passive component layer are produced by using a normal photomask to perform the exposure process in one time. Moreover, the corresponding positions and quantities of the high-precision regions of the active component layer are fixed, so that the photomasks having the same pattern are used in the front-end manufacturing process to produce the inkjet print head chips in any size. Under different requirements, 1-inch three inkjet print head chips or multi-color wide-format inkjet print head chips can be configured through the 1.5-inch and/or 2-inch narrow type inkjet print head chip without the need to reconstruct the photomasks of the front-end manufacturing process. Moreover, when the active component layer is configured by different high-precision regions, it is also not need to replace the photomasks, but only needs to adjust the photomask used for the passive component layer to change the position and layout of the heaters, the electrode pads and the circuit traces of the passive component layer to complete the manufacturing without replacing the photomasks used for the active component layer. This is advantageous to save time and cost.

While the invention has been described in terms of what is presently considered to be the most practical and preferred embodiments, it is to be understood that the invention is not need to be limited to the disclosed embodiments. On the contrary, it is intended to cover various modifications and similar arrangements included within the spirit and scope of the appended claims so as to encompass all such modifications and similar structures.

What is claimed is:

1. A narrow type inkjet print head chip, comprising:

a silicon substrate, comprising:

a first long side;

a second long side opposite to the first long side;

a first short side connected to the first long side and the second long side; and a second short side connected to the first long side and the second long side, and opposite to the first short side;

an active component layer stacked on the silicon substrate and comprising:

a plurality of electro static discharge (ESD) protection units disposed adjacent to the first long side and arranged along the first long side;

a plurality of encoder switches disposed adjacent to the first long side and arranged along the first long side;

a plurality of discharge protection units disposed adjacent to the first long side and arranged along the first long side; and a plurality of heater switches disposed in parallel with the plurality of electro static discharge (ESD) protection units;

wherein the plurality of electro static discharge (ESD) protection units, the plurality of encoder switches, the plurality of discharge protection units and the plurality of heater switches are disposed in each of at least two high-precision regions of the active component layer, respectively, wherein corresponding positions and quantities of the plurality of electro static discharge (ESD) protection units, the plurality of encoder switches, the plurality of discharge protection units and the plurality of heater switches are the same in the at least two high-precision regions; and a passive component layer stacked on the active component layer and comprising:

a plurality of heaters arranged along the second long side;

a plurality of electrode pads;

a plurality of encoders arranged along the first long side and adjacently connected to the plurality of encoder switches, respectively; and a plurality of circuit traces electrically connected to the plurality of electro static discharge (ESD) protection units, the plurality of encoder switches, the plurality of discharge protection units, the plurality of heater switches, the plurality of heaters, the plurality of electrode pads and the plurality of encoders.

2. The narrow type inkjet print head chip according to claim 1, wherein each of the plurality of electro static discharge (ESD) protection units is a pull-down resistor protection device.

3. The narrow type inkjet print head chip according to claim 1, wherein each of the plurality of electro static discharge (ESD) protection units, the plurality of heater switches and the plurality of the encoder switches is a n-type metal oxide semiconductor (NMOS) element.

4. The narrow type inkjet print head chip according to claim 1, wherein the at least two high-precision regions comprise a first high-precision region and a second high-precision region, wherein the first high-precision region and the second high-precision region are in a long and narrow shape, and arranged along the first long side, wherein the corresponding positions and quantities of the plurality of electro static discharge (ESD) protection units, the plurality of encoder switches, the plurality of discharge protection units and the plurality of heater switches are the same in the first high-precision region and the second high-precision region.

5. The narrow type inkjet print head chip according to claim 1, wherein the at least two high-precision regions comprise a first high-precision region, a second high-precision region and a third high-precision region, wherein the first high-precision region, the second high-precision region and the third high-precision region are in a long and narrow shape, and arranged along the first long side, wherein the corresponding positions and quantities of the plurality of electro static discharge (ESD) protection units, the plurality of encoder switches, the plurality of discharge protection units and the plurality of heater switches are the same in the first high-precision region, the second high-precision region and the third high-precision region.

6. The narrow type inkjet print head chip according to claim 1, wherein the passive component layer is made of at least one material selected from the group consisting of gold, aluminum, tantalum and a combination thereof.

7. The narrow type inkjet print head chip according to claim 1, wherein the plurality of electrode pads are arranged along the first short side and the second short side.

8. The narrow type inkjet print head chip according to claim 1, wherein the plurality of electrode pads are arranged in an L-shape.

9. The narrow type inkjet print head chip according to claim 1, wherein the plurality of electrode pads are arranged along the first long side.

* * * * *